US009254855B2

(12) United States Patent
Kernwein et al.

(10) Patent No.: US 9,254,855 B2
(45) Date of Patent: Feb. 9, 2016

(54) COMPUTER-IMPLEMENTED METHOD AND SYSTEM FOR MANAGING CONDITIONAL AUTHORITIES IN A VEHICLE NETWORK

(71) Applicant: Westinghouse Air Brake Technologies Corporation, Wilmerding, PA (US)

(72) Inventors: Jeffrey D. Kernwein, Cedar Rapids, IA (US); Ann K. Grimm, Cedar Rapids, IA (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 59 days.

(21) Appl. No.: 14/299,658

(22) Filed: Jun. 9, 2014

(65) Prior Publication Data

US 2015/0353110 A1 Dec. 10, 2015

(51) Int. Cl.

| | |
|---|---|
| ***G06F 19/00*** | (2011.01) |
| ***B61L 27/00*** | (2006.01) |
| ***B61L 23/22*** | (2006.01) |
| ***B61L 25/02*** | (2006.01) |

(52) U.S. Cl.

CPC ..... *B61L 27/0011* (2013.01); *B61L 23/22* (2013.01); *B61L 25/02* (2013.01)

(58) Field of Classification Search

None

See application file for complete search history.

(56) References Cited

U.S. PATENT DOCUMENTS

| | | | | |
|---|---|---|---|---|
| 2004/0006413 | A1* | 1/2004 | Kane | B61L 3/008 701/19 |
| 2007/0225878 | A1* | 9/2007 | Kumar | B61L 3/006 701/19 |
| 2008/0167767 | A1* | 7/2008 | Brooks | B61L 3/006 701/20 |

* cited by examiner

*Primary Examiner* — Adam Alharbi

(74) *Attorney, Agent, or Firm* — The Webb Law Firm

(57) ABSTRACT

A computer-implemented method for managing conditional authorities in a vehicle network for a target train, including: generating at least one conditional authority for the target train, the at least one conditional authority comprising authority data related to at least one identifying train; establishing at least one direct or indirect communication link between the target train and the at least one identifying train; determining position data for the at least one identifying train; comparing at least a portion of the position data with at least a portion of the authority data; and based at least partially on the comparison, generating at least one indication that the target train is authorized to proceed. Systems for managing conditional authorities in a vehicle network for a target train are also disclosed.

27 Claims, 6 Drawing Sheets

COMPUTER-IMPLEMENTED METHOD AND SYSTEM FOR MANAGING CONDITIONAL AUTHORITIES IN A VEHICLE NETWORK

BACKGROUND OF THE INVENTION

1. Field of the Invention

This invention relates generally to vehicle systems and networks, such as railway systems including trains travelling in a track or rail network, and in particular to data management systems and methods for use in managing conditional authorities in a vehicle network, preferably a vehicle network of multiple trains operating in a track network.

2. Description of Related Art

Vehicle systems and networks exist throughout the world, and, at any point in time, a multitude of vehicles, such as cars, trucks, buses, trains, and/or the like, are travelling throughout the system and network. In order to effectively manage and control such vehicles, a central controller, e.g., intermediate or central dispatch (or some back office server), tracks the vehicles, e.g., trains, travelling in the network. This management and control is typically implemented and operated based upon identifying the position of each train in the network, or a specific portion of the network. For example, this central controller may issue authorities that provide an indication (or permission) for a vehicle to move into or operate within a specified portion of the network, such as permitting a train to move into or operate within a block or section of track. These authorities may also take the form of a conditional authority, where the target train or vehicle (e.g, the named train or vehicle) is not permitted or authorized to move into or operate within a portion of the network until one or more other vehicles are clear.

In one exemplary and existing system, a railroad dispatcher issues a form-based movement authority to a train that is not in effect upon its issuance, but rather is dependent on the movement of another train or other trains. This provides the dispatcher with a degree of flexibility in managing workload, allowing him or her to "work ahead" on issuing authorities in a heavily trafficked track warrant area or territory. In one example, and as illustrated in FIG. 1, the authority issued to train (A) includes the condition that it is "in effect after arrival" of up to three trains (B), (C), and (D) moving in an opposing direction. The authority may include an "at" location or "entry point" specifying where the trains will meet (or where train (A) will enter the portion of track), or alternatively or additionally, the authority specifies at least the last identifying train (e.g., train (D), after which train (A) is authorized to proceed. The authority is conditional in that it is not in effect until all of the trains (B), (C), and (D) are confirmed to have passed the "at" location or entry point, or that the last identifying train is clear.

In another example, and as illustrated in FIG. 2, the condition "in effect behind" is a condition where the order of movement of trains (A), (B), (C), and (D) are all in the same direction. Some authority forms refer to this condition as "do not foul limits ahead." Further, in this example, the "at" location or entry point may be augmented with a specified distance, where each of trains (B), (C), and (D) must be passed the "at" location or entry point by some distance before the authority for train (A) to pass the "at" location or entry point is effective. Also, as discussed above, the authority may include the identity of the last identifying train (e.g., train (D)), after which train (A) may safely proceed behind.

In certain railroad and train control and management systems, e.g., the I-ETMS® of Wabtec Corp., enforcement of these conditional authorities is required in order to prevent a train from entering an unauthorized section of track until the condition for making the authority effective has occurred. In one exemplary embodiment of an existing system, the location of the named trains (referred to as "identifying trains") in the conditional authority are confirmed by the train crew via a prompt or similar interaction on the display of the on-board computer on the locomotive. The terms "identifying train" or "identifying locomotive" refer to the train or locomotive listed in the movement authority dataset of a conditional authority as being in the lead of one of the trains for which the train holding that authority must wait. Assuming the crew answers the prompt correctly, the appropriate protection between trains is achieved. However, in some situations, the crew may respond incorrectly, assuming a train has passed when, in reality, it has not. This creates a situation where the authority of the train or trains named in the conditional authority may be violated, possibly resulting in a collision. The Federal Railroad Association has expressed its concern regarding this potential hazard.

Continuing with the above exemplary embodiment of an existing implementation, the crew is presented with a prompt to indicate the arrival of the trains named in the conditional authority, while the train is located outside of the limits of that authority. "Soft-key" labels are displayed to the operator, and these labels indicate the locomotive identification (e.g., reporting mark and vehicle number) of the identifying train/locomotive, and the timetable direction (i.e., North, South, East, or West) in which the train is travelling. An example operator display with such prompts is illustrated in FIG. 3 (where no trains in the conditional authority have yet "arrived"). As each train arrives, the crew presses the soft-key for that train. The soft-key label changes from red to blue, and the soft-key text changes from "due" to "arrived" (as shown in FIG. 4 (where one train in the conditional authority has "arrived")). If the crew presses the key in error, pressing the same key again changes the color back to red and the text back to "due." With reference to FIG. 5, when the key for the last train is pressed, an "all arrived" soft-key label is displayed. Pressing this key serves as a final confirmation and removes the zero (0) mph target over the authority limits.

While the above-discussed methodology and process facilitates the effective management of trains subject to conditional authorities, there is room in the field of train management for improved systems and methods for managing, controlling, and tracking a plurality of trains moving within the track network.

SUMMARY OF THE INVENTION

Generally, provided are an improved computer-implemented method and system for managing conditional authorities in a vehicle network. Preferably, provided are an improved computer-implemented method and system for managing conditional authorities in a vehicle network that are useful in connection with railway system and the trains travelling therein. Preferably, provided are an improved computer-implemented method and system for managing conditional authorities in a vehicle network that facilitate the ability to manage data from multiple locomotives and/or trains travelling in a track or rail network, particularly with respect to trains operating under conditional authorities. Preferably, provided are an improved computer-implemented method and system for managing conditional authorities in a vehicle network that facilitate effective communication and data exchange between trains in order to accurately manage authorizations and conditional authorities.

According to one preferred and non-limiting embodiment, provided is a computer-implemented method for managing conditional authorities in a vehicle network for a target train, including: generating at least one conditional authority for the target train, the at least one conditional authority comprising authority data related to at least one identifying train; establishing at least one direct or indirect communication link between the target train and the at least one identifying train; determining position data for the at least one identifying train; comparing at least a portion of the position data with at least a portion of the authority data; and based at least partially on the comparison, generating at least one indication that the target train is authorized to proceed.

According to a further preferred and non-limiting embodiment, provided is a system for managing conditional authorities in a vehicle network for a target train, including: receiving at least one conditional authority by the target train, the at least one conditional authority comprising authority data related to at least one identifying train; establishing at least one direct or indirect communication link between the target train and the at least one identifying train; receiving, by the target train, position data of the at least one identifying train; comparing, by the target train, at least a portion of the position data with at least a portion of the authority data; based at least partially on the comparison, generating at least one indication that the target train is authorized to proceed; and based at least partially on the at least one indication, displaying, on a visual display device in at least one locomotive of the target train, an authorization indication.

According to another preferred and non-limiting embodiment, provided is a system for managing conditional authorities in a vehicle network for a target train, including: receiving at least one conditional authority by the target train, the at least one conditional authority comprising authority data related to at least one identifying train; transmitting, by the target train to the at least one identifying train, at least a portion of the authority data; comparing, by the at least one identifying train, position data with at least a portion of the authority data; directly or indirectly transmitting, by the at least one identifying train to the target train, the results of the comparison; based at least partially on the results of the comparison, generating at least one indication that the target train is authorized to proceed; and based at least partially on the at least one indication, displaying, on a visual display device in at least one locomotive of the target train, an authorization indication.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
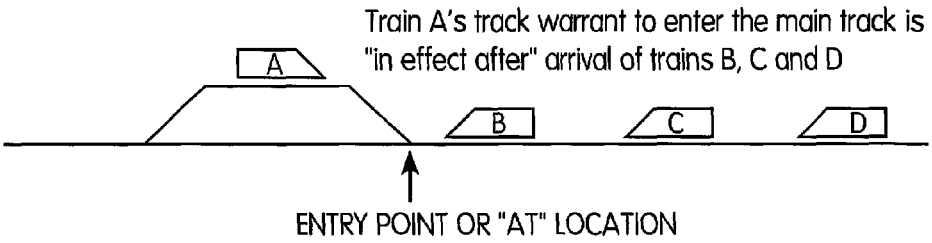
FIG. 1 (PRIOR ART)
FIG. 1 is schematic view of a movement authority distribution scenario for a specified arrangement of trains in a track network according to the prior art.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

As used herein, the terms "communication" and "communicate" refer to the receipt, transmission, or transfer of one or more signals, messages, commands, or other type of data. For one unit or device to be in communication with another unit or device means that the one unit or device is able to receive data from and/or transmit data to the other unit or device. A communication may use a direct or indirect connection, and may be wired and/or wireless in nature. Additionally, two units or devices may be in communication with each other even though the data transmitted may be modified, processed, routed, etc., between the first and second unit or device. For example, a first unit may be in communication with a second unit even though the first unit passively receives data, and does not actively transmit data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, and/or the like. Further, a variety of wired or wireless network devices may be used, including, but not limited to, a wireless network device, a wired network device, a WiFi network device, a Bluetooth network device, a Zigbee network device, a WirelessHART network device, a GPRS network device, an ultra-wideband network device, a cable network device, a wide-band network device, a multi-radio network device, and/or the like.

The present invention, including the various computer-implemented and/or computer-designed aspects, methods, processes, and configurations, may be implemented on a variety of computing devices and systems, including the client devices and/or server computer, wherein these computing devices include the appropriate processing mechanisms and computer-readable media for storing and executing computer-readable instructions, such as programming instructions, code, and/or the like. In addition, aspects of this invention may be implemented on existing controllers, control systems, and computers integrated or associated with, or positioned on, the locomotive and/or any of the railcars. For example, the presently-invented system or any of its functional components can be implemented wholly or partially on a train management computer, a Positive Train Control computer, an on-board controller or computer, a railcar computer, and/or the like. In addition, the presently-invented systems and methods may be implemented in a laboratory environment in one or more computers or servers. Still further, the functions and computer-implemented features of the present invention may be in the form of software, firmware, hardware, programmed control systems, microprocessors, and/or the like.

Figure 6:
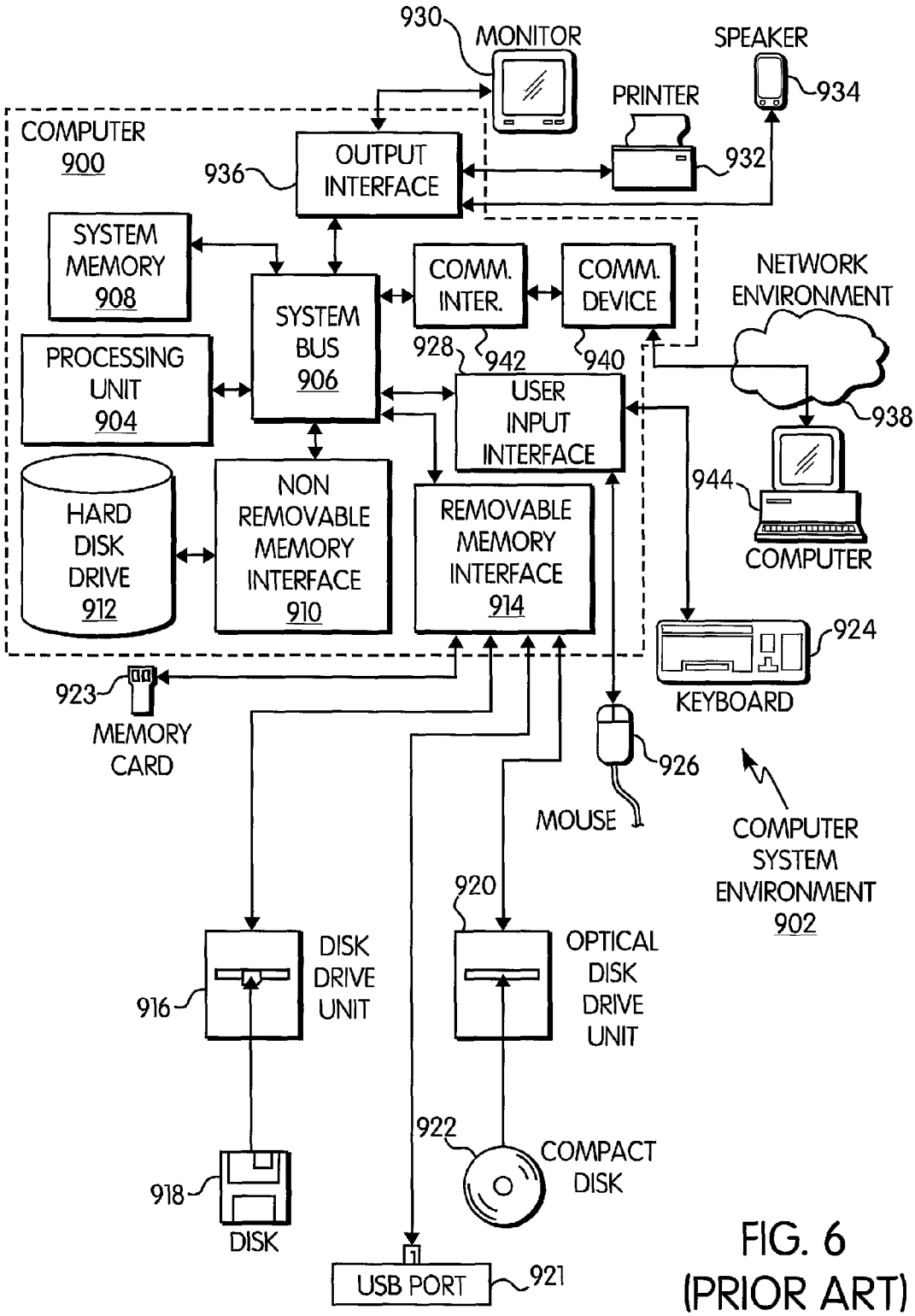
FIG. 6 (PRIOR ART)
FIG. 6 is a schematic view of a computer system and environment according to the prior art.

As shown in FIG. 6, and according to the prior art, personal computers 900, 944, in a computing system environment 902 may be provided or utilized. This computing system environment 902 may include, but is not limited to, at least one computer 900 having certain components for appropriate operation, execution of code, and creation and communication of data. For example, the computer 900 includes a processing unit 904 (typically referred to as a central processing unit or CPU) that serves to execute computer-based instructions received in the appropriate data form and format. Further, this processing unit 904 may be in the form of multiple processors executing code in series, in parallel, or in any other manner for appropriate implementation of the computer-based instructions.

In order to facilitate appropriate data communication and processing information between the various components of the computer 900, a system bus 906 is utilized. The system bus 906 may be any of several types of bus structures, including a memory bus or memory controller, a peripheral bus, or a local bus using any of a variety of bus architectures. In particular, the system bus 906 facilitates data and information communication between the various components (whether internal or external to the computer 900) through a variety of interfaces, as discussed hereinafter.

The computer 900 may include a variety of discrete computer-readable media components. For example, this computer-readable media may include any media that can be accessed by the computer 900, such as volatile media, non-volatile media, removable media, non-removable media, etc. As a further example, this computer-readable media may include computer storage media, such as media implemented in any method or technology for storage of information, such as computer-readable instructions, data structures, program modules, or other data, random access memory (RAM), read only memory (ROM), electrically erasable programmable read only memory (EEPROM), flash memory, or other memory technology, CD-ROM, digital versatile disks (DVDs), or other optical disk storage, magnetic cassettes, magnetic tape, magnetic disk storage, or other magnetic storage devices, or any other medium which can be used to store the desired information and which can be accessed by the computer 900. Further, this computer-readable media may include communications media, such as computer-readable instructions, data structures, program modules, or other data in other transport mechanisms and include any information delivery media, wired media (such as a wired network and a direct-wired connection), and wireless media. Computer-readable media may include all machine-readable media with the sole exception of transitory, propagating signals. Of course, combinations of any of the above should also be included within the scope of computer-readable media.

As seen in FIG. 6, the computer 900 further includes a system memory 908 with computer storage media in the form of volatile and non-volatile memory, such as ROM and RAM. A basic input/output system (BIOS) with appropriate computer-based routines assists in transferring information between components within the computer 900 and is normally stored in ROM. The RAM portion of the system memory 908 typically contains data and program modules that are immediately accessible to or presently being operated on by processing unit 904, e.g., an operating system, application programming interfaces, application programs, program modules, program data and other instruction-based computer-readable codes.

With continued reference to FIG. 6, the computer 900 may also include other removable or non-removable, volatile or non-volatile computer storage media products. For example, the computer 900 may include a non-removable memory interface 910 that communicates with and controls a hard disk drive 912, i.e., a non-removable, non-volatile magnetic medium; and a removable, non-volatile memory interface 914 that communicates with and controls a magnetic disk drive unit 916 (which reads from and writes to a removable, non-volatile magnetic disk 918), an optical disk drive unit 920 (which reads from and writes to a removable, non-volatile optical disk 922, such as a CD ROM), a Universal Serial Bus (USB) port 921 for use in connection with a removable memory card, etc. However, it is envisioned that other removable or non-removable, volatile or non-volatile computer storage media can be used in the exemplary computing system environment 900, including, but not limited to, magnetic tape cassettes, DVDs, digital video tape, solid state RAM, solid state ROM, etc. These various removable or non-removable, volatile or non-volatile magnetic media are in communication with the processing unit 904 and other components of the computer 900 via the system bus 906. The drives and their associated computer storage media discussed above and illustrated in FIG. 6 provide storage of operating systems, computer-readable instructions, application programs, data structures, program modules, program data and other instruction-based computer-readable code for the computer 900 (whether duplicative or not of this information and data in the system memory 908).

A user may enter commands, information, and data into the computer 900 through certain attachable or operable input devices, such as a keyboard 924, a mouse 926, etc., via a user input interface 928. Of course, a variety of such input devices may be utilized, e.g., a microphone, a trackball, a joystick, a touchpad, a touch-screen, a scanner, etc., including any arrangement that facilitates the input of data, and information to the computer 900 from an outside source. As discussed, these and other input devices are often connected to the processing unit 904 through the user input interface 928 coupled to the system bus 906, but may be connected by other interface and bus structures, such as a parallel port, game port, or a universal serial bus (USB). Still further, data and information can be presented or provided to a user in an intelligible form or format through certain output devices, such as a monitor 930 (to visually display this information and data in electronic form), a printer 932 (to physically display this information and data in print form), a speaker 934 (to audibly present this information and data in audible form), etc. All of these devices are in communication with the computer 900 through an output interface 936 coupled to the system bus 906. It is envisioned that any such peripheral output devices be used to provide information and data to the user.

The computer 900 may operate in a network environment 938 through the use of a communications device 940, which is integral to the computer or remote therefrom. This communications device 940 is operable by and in communication to the other components of the computer 900 through a communications interface 942. Using such an arrangement, the computer 900 may connect with or otherwise communicate with one or more remote computers, such as a remote computer 944, which may be a personal computer, a server, a router, a network personal computer, a peer device, or other common network nodes, and typically includes many or all of the components described above in connection with the computer 900. Using appropriate communication devices 940, e.g., a modem, a network interface or adapter, etc., the computer 900 may operate within and communication through a local area network (LAN) and a wide area network (WAN), but may also include other networks such as a virtual private network (VPN), an office network, an enterprise network, an intranet, the Internet, etc. It will be appreciated that the network connections shown are exemplary and other means of establishing a communications link between the computers 900, 944 may be used.

As used herein, the computer 900 includes or is operable to execute appropriate custom-designed or conventional software to perform and implement the processing steps of the method and system of the present invention, thereby, forming a specialized and particular computing system. Accordingly, the presently-invented method and system may include one or more computers 900 or similar computing devices having a computer-readable storage medium capable of storing computer-readable program code or instructions that cause the processing unit 904 to execute, configure or otherwise implement the methods, processes, and transformational data manipulations discussed hereinafter in connection with the present invention. Still further, the computer 900 may be in the form of any type of computing device having the necessary processing hardware to appropriately process data to effectively implement the presently-invented computer-implemented method and system.

Figure 7:
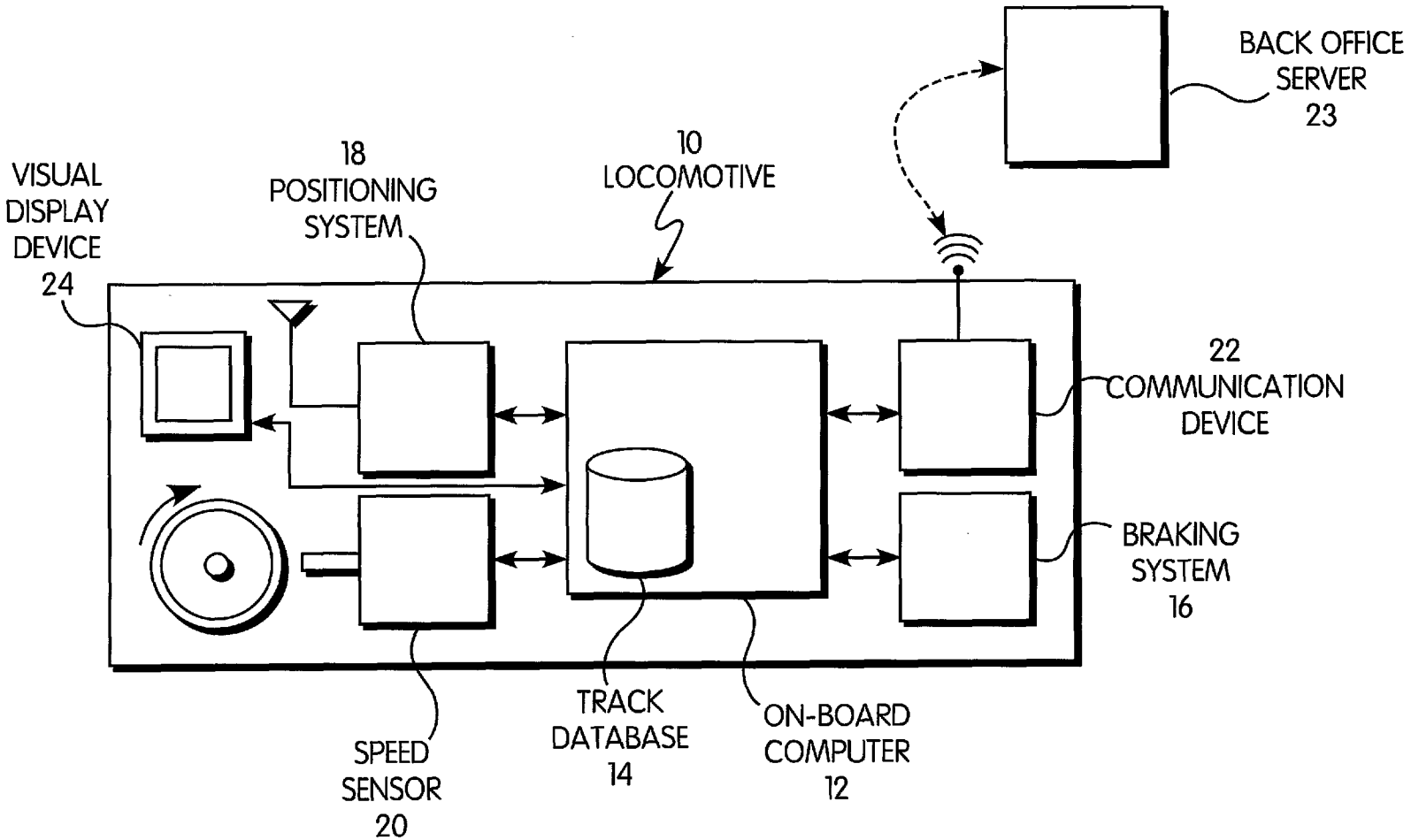
FIG. 7 is a schematic view of a train control system in a locomotive of a train for use in connection with a computer-implemented method and system for managing conditional authorities in a vehicle network according to the present invention.

The computer-implemented method and system may be implemented in a variety of systems and vehicular networks; however, the methods and systems described herein are particularly useful in connection with a railway system and network. Accordingly, the presently-invented methods and systems can be implemented in various known train control and management systems, e.g., the above-referenced I-ETMS® of Wabtec Corp. In one preferred and non-limiting embodiment, and as illustrated in FIG. 7, the systems and methods described herein may be implemented on or in connection with a train with at least one locomotive 10 having an on-board computer 12. Of course, the on-board computer 12 may be located at any position or orientation on the train. The on-board computer 12 (or on-board controller, on-board computer system, train management computer, and/or the like, and which performs the calculations for the Positive Train Control (PTC) system) includes a track database 14 populated with data and/or which receives specified data and information from other trains, remote servers, back office servers, central dispatch, and/or the like, where this data may include track profile data, train data, information about switch locations, track heading changes (e.g., curves, and distance measurements), train consist information (e.g., the number of locomotives, the number of cars, the total length of the train, and/or the like), and/or the like.

The on-board computer 12 also includes or is in communication with the appropriate braking system 16 and other software or programs to effectively implement the systems and methods according to the present invention. In one preferred and non-limiting embodiment, the on-board computer 12 receives real-time inputs from various locomotive control settings or components, including a positioning (or navigation) system 18, e.g., a GPS receiver, at least one wheel tachometer/speed sensor 20, and/or the like. Further, the on-board computer 12 includes or is in communication with a communication device 22 (e.g., a data radio, a communication interface, a communication component, and/or the like), which facilitates communication by or between locomotives 10 and/or the locomotive 10 and some remote server or computer system, e.g., a central controller, a back office server 23, a remote server, central dispatch, back office PTC components, various wayside devices, such as signal or switch monitors, or other on-board computers 12 in the railway system. Further, this communication may occur wirelessly or in a "hard wired" form, e.g., over the rails of the track. In addition, the on-board computer 12 includes or is communication with a visual display device 24, such as the operator's display in the cab of the locomotive 10. This visual display device 24 is used to present information and data to the operator of the train. In one preferred and non-limiting embodiment, the track database 14 includes information about switch locations, track heading changes (e.g., curves) and distance measurements, while the on-board computer 12 receives, from, e.g., the back office server 23, train consist information (e.g., number of locomotives, cars, and total length of the train). Accordingly, the presently-invented system and methods can be effectively implemented and used by or on such a locomotive 10 having such an on-board computer 12 and associated components. Of course, it is envisioned that any type of train management system can be used within the context and scope of the present invention.

In one preferred and non-limiting embodiment, provided is a computer-implemented method (and system) for managing conditional authorities in a vehicle network for a target train (i.e., the train receiving the conditional authority). In this embodiment, the method includes generating a conditional authority for the target train, where the conditional authority includes authority data relating to at least one identifying train. In one preferred and non-limiting embodiment, the authority data includes one or more of the following: entry point data (such as a specific point of interest), "at" location data (such as a specific location of interest), train data (such as any train-related data point, e.g., identification, location, operating parameter, etc.), identifying train data (such as any train-related data directed to an identifying train) and/or condition data (such as a specified condition that must be met prior to the target train proceeding).

Next, a direct or indirect communication link is established between the target train and the at least one identifying train, and position data is determined for the at least one identifying train. As discussed hereinafter, this determination may be made by the target train, the at least one identifying train, and/or the back office server 23 (or some other remote server or communication system). Accordingly, information and data may be transmitted by or relayed (with or without modification) between one or more of the following: the target train, an identifying train, the back office server 23, a wayside device, or any combination thereof.

In one preferred and non-limiting embodiment, at least a portion of the position data is compared with at least a portion of the authority data, and based at least partially on this comparison, at least one indication (such as a prompt, message, textual indication, aural indication, and/or the like) is generated or provided on the visual display device 24, e.g., the operator's display, indicating that the target train is authorized to proceed (or, in some embodiments, pass the at least one entry point or "at" location). Accordingly, and based upon the communication of appropriate data by or between the locomotives of the target train and the identifying train, and in accordance with the conditional authority (normally issued by central dispatch, e.g., the back office server 23), the target train is authorized to proceed in to a block or section of track ahead of the target train ahead of the train on its route.

Figure 2:
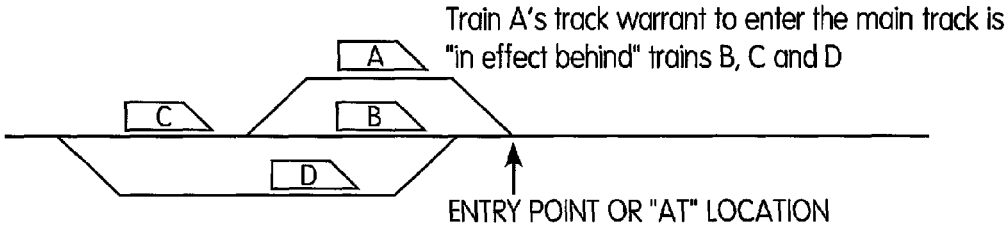
FIG. 2 (PRIOR ART)
FIG. 2 is a schematic view of another movement authority distribution scenario for a specified arrangement of trains in a track network according to the prior art.
Figure 3:
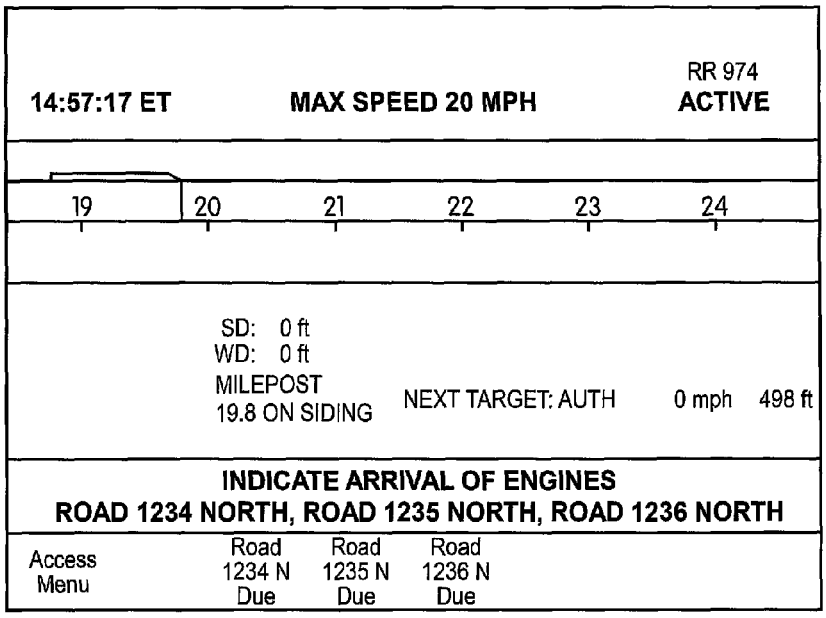
FIG. 3 (PRIOR ART)
FIG. 3 is an exemplary operator display with a prompt in the locomotive of the train providing prompts for use in connection with the movement authority distribution scenario of FIG. 1 or FIG. 2 according to the prior art.
Figure 4:
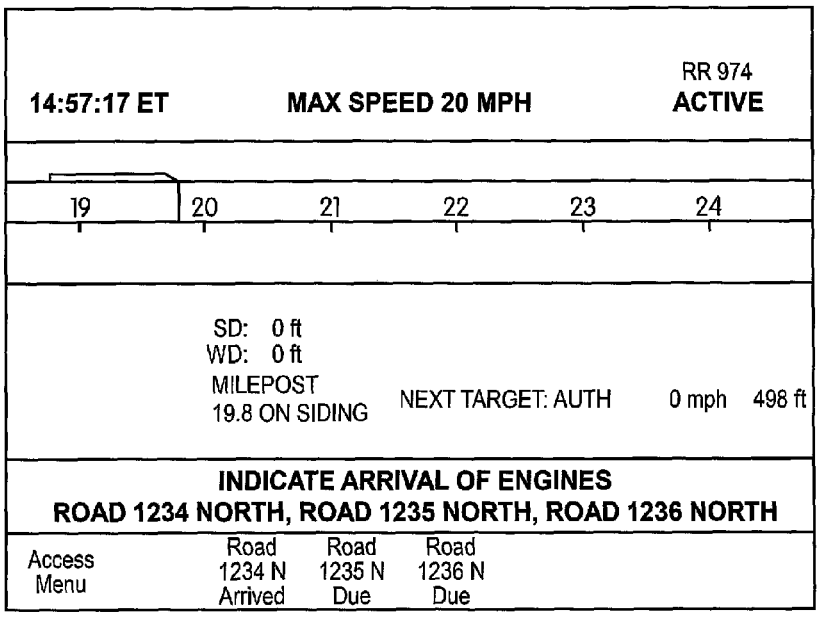
FIG. 4 (PRIOR ART)
FIG. 4 is the exemplary operator display of FIG. 3, wherein the prompt has changed based upon operator input.
Figure 5:
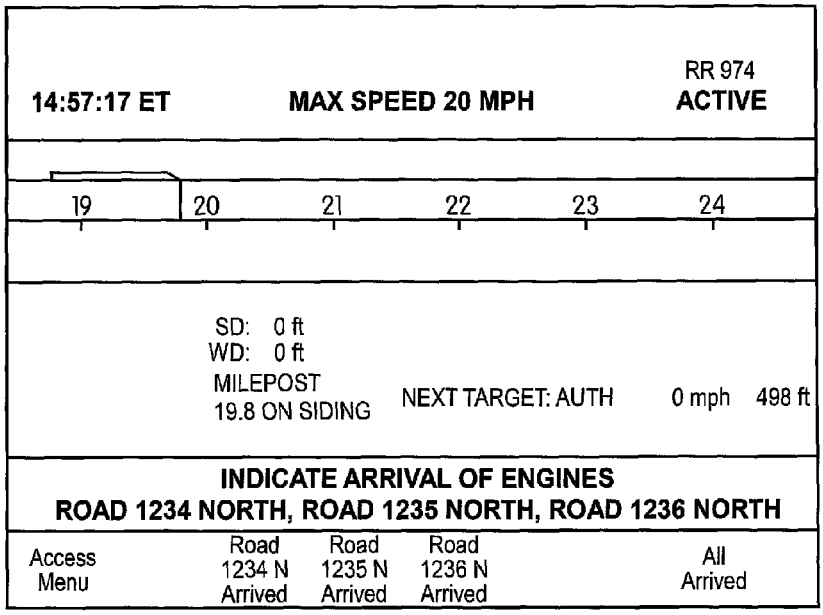
FIG. 5 (PRIOR ART)
FIG. 5 is the exemplary operator display of FIG. 3, wherein the prompt has changed based upon operator input.

In another preferred and non-limiting embodiment, all or a portion of data collected by the target train or any of the identifying trains is transmitted to central dispatch or the back office server 23 for use in issuing or managing further conditional authorities. For example, this data may include authority data, entry point data, "at" location data, train data, identifying train data, condition data, target train data, position data, indication data, track data, switch data, heading data, distance data, locomotive data, train data, navigation data, tachometer data, or any combination thereof. In addition, and with respect to the nature and content of the conditional authorities, such authorities or authority types may include direction data (e.g., the direction that a train is travelling), position data (e.g., the position of the train, the position of the locomotive, the position of the head-of-train, the position of the end-of-train, the relative position between multiple trains, and/or the like), condition data (information about conditions that must occur prior to the authority being effective, e.g., the identifying train must be at or beyond a certain location or position), "in effect after arrival" data (i.e., the authority is effective for the target train after arrival of an identifying train at or passed the entry point (e.g., see FIG. 1)), "in effect behind" data (i.e., the authority is effective for the target train behind one or more identifying trains, after they have passed the entry point or some "at" location (e.g., see FIG. 2)), or any combination thereof.

In another preferred and non-limiting embodiment, the method includes: determining (whether by the target train and/or an identifying train) each identifying train in the conditional authority based upon at least a portion of the authority data, e.g., identifying train data; and directly or indirectly transmitting at least a portion of the position data from each identifying train to the target train. In one preferred embodiment, this direct or indirect transmission is responsive to a request, by the target train, for the position data, such as using the communication device 22 in the locomotive 10 of the target train. In another preferred and non-limiting embodiment, the method includes directly or indirectly receiving, at the target train, at least a portion of the position data as transmitted from at least one of the following: at least one identifying train, at least one back office server 23, at least one other train (which may be used as an intermediate or repeater system), and/or at least one wayside device (which may be some wayside communication device that acts as an intermediate or repeater system). In other embodiments, the position data for each identifying train is populated or generated in the track database 14.

In one preferred and non-limiting embodiment, the method includes transmitting position data (from each identifying train to the target train), such as using the communication device 22 in the locomotive 10 of each identifying train. Of course, and as discussed, this information may be relayed by or between the various trains, wayside devices, and/or communicated by central dispatch or the back office server 23. This position data may include at least one of the following: train leading edge data (e.g., head-of-train information), train trailing edge data (e.g., end-of-train information), milepost data, prefix data, suffix data, track name, subdivision identifier, track data, railroad data, block identifier, offset data, or any combination thereof.

In another preferred and non-limiting embodiment, and based at least partially on the position data received from each identifying train, the method further includes determining, by the target train (e.g., the on-board computer 12), whether at least one identifying train meets at least one condition in the authority data. If the position or location of at least one identifying train indicates that it meets the condition, the method includes generating a "clear" indication, and if the position or location of the at least one identifying train indicates that it does not meet the condition: (i) maintaining a "not clear" indication; and (ii) requesting, receiving, or determining subsequent position data from the identifying train.

In one embodiment, the "clear" indication is based at least partially on the identification of an "in effect after arrival" indication or an "in effect behind" indication in the conditional authority. Further, and in one preferred and non-limiting embodiment, the "clear" indication is provided only after the "last" identifying train is clear and the target train is authorized to proceed. For example, the target train is cleared only when the trailing edge of the last identifying train in the authority is safely passed the location where the target train will enter the block or section of track that is the subject of the conditional authority.

In another preferred and non-limiting embodiment, the condition includes one or more of the following: at least one entry point, at least one "at" location, at least one condition of the identifying train, at least one condition of the target train, a position or location of the identifying train, the position or location of the target train, or any combination thereof. In another embodiment, the condition is determined after receipt of the conditional authority.

In a further preferred and non-limiting embodiment, the target train determines the position or location of at least one identifying train based at least partially on position data. If the position or location of the identifying train indicates that it meets or satisfies the condition in the conditional authority, i.e., the authority data associated with the conditional authority, a "clear" indication is generated. However, if the position or location of the identifying train indicates that it does not meet the condition of the conditional authority, a "not clear" indication is maintained, and subsequent position data directed to the identifying train is requested, received, or determined. As discussed above, the "clear" indication may be based upon the identification of an "in effect after arrival" indication or condition or an "in effect behind" indication or condition.

In another preferred and non-limiting embodiment, the position data includes position uncertainty data, which may be determined by the identifying train (or in other embodiments, the target train). In particular, this uncertainty data may be used by the target train and/or the identifying train to determine how "certain" the identifying train is regarding its position, or a portion thereof. This uncertainty data may lead to the determination or configuration of a safety factor or buffer that provides the target train with an assurance that the identifying train is completely passed the entry point. This avoids any chance of collision between any portion of the target train and the identifying train. This safety factor or buffer may be configured by the railroad, populated on the track database 14, dynamically determined by the target train and/or the identifying train, timer data, distance data, or any combination thereof.

In another preferred and non-limiting embodiment, the position data is determined by each identifying train, where this position data includes the position or location of the identifying train with respect to at least one condition in the conditional authority. If the position or location of at least one identifying train indicates that it meets or satisfies the condition in the conditional authority, a "clear" indication is generated. However, if the position or location of the identifying train indicates that it does not meet the condition of the conditional authority, a "not clear" indication is maintained, and subsequent position data directed to the identifying train is requested, received, or determined. As discussed above, the "clear" indication may be based upon the identification of an "in effect after arrival" indication or condition or an "in effect behind" indication or condition.

As discussed, the authority data may include a variety of data points and information to allow the target train to effectively comply with the conditional authority. In one preferred and non-limiting embodiment, the authority data in the conditional authority includes the identification of one or more identifying trains, as well as an identification of the condition that must occur in order for the target train to safely proceed. In one preferred and non-limiting embodiment, that condition is based upon some entry point, "at" location, or target location, e.g., in an "in effect after arrival" condition, the location where the target train will be authorized to enter the block or section of track only after the trailing edge of the last train is completely clear of the entry point, "at" location, or target location. In another preferred and non-limiting embodiment, the condition is based upon the position of the trailing edge of the last identifying train, e.g., in an "in effect behind" condition, the position of the trailing edge of the last identifying train that is ahead of the target train.

In a further preferred and non-limiting embodiment, the request for position data further includes the position of the entry point, and the method further includes determining, by the identifying train, at least one position or location on its calculated route. In one embodiment, position data is directly or indirectly transmitted to or received by the target train and includes the position of the identifying train with respect to this position or location. Further, in this embodiment, the position data includes at least one of the following: an indication that the determined position or location is behind the identifying train on its calculated route, an indication that the determined position or location is ahead of the identifying train on its calculated route, or the determined position or location is not on its calculated route. Accordingly, in this embodiment, the appropriate determinations of relative positioning are made by the identifying train. In addition, and as discussed, the position data may include position uncertainty data. In addition, and in a further preferred and non-limiting embodiment, if the determined position or location does not appear on the route travelled by the identifying train, the method further includes at least one of the following: voiding the at least one conditional authority, issuing at least one non-conditional authority, or any combination thereof. In another preferred and non-limiting embodiment, the target train determines at least one entry point or "at" location based at least partially on the authority data in or derived from the conditional authority.

In one preferred and non-limiting embodiment, the direct or indirect communication link between the target train and the identifying train is a secured communication link directly between the target train and the identifying train. In this embodiment, this secured communication link can be terminated based at least partially on at least one of the following: a termination command is received by the identifying train, a determination is made that the identifying train has passed a determined position or location, or any combination thereof. In another embodiment, the communication link between the target train and the identifying train is an indirect communication link established between the target train, a back office server 23 (or some other remote server or computer), and the identifying train, or, alternatively, between the target train, an intermediate train (e.g., another identifying train), and the identifying train. In addition, the indirect communication link is established between any two or more of the following: the identifying train, the back office server 23, another train, a wayside device, or any combination thereof. In another preferred and non-limiting embodiment, the method further includes generating a status of the identifying train (e.g., with respect to some determined position or location), and displaying the status on the visual display device 24, e.g., the operator's display, in the locomotive 10 of the target train.

In another preferred and non-limiting embodiment, the method includes: determining that the target train and/or identifying train is not equipped with a specified train control system; voiding the conditional authority; and issuing a non-conditional authority. Accordingly, the method and system of the present invention can determine whether it can be effectively used or implemented in a variety of situations or scenarios. This non-conditional authority does not permit the target train or identifying train to make any type of train control or management decisions with respect to other trains.

In a further preferred and non-limiting embodiment, provided is a system for managing conditional authorities in a vehicle network for a target train, including: receiving a conditional authority by the target train, wherein the conditional authority includes authority data related to at least one identifying train; establishing at least one direct or indirect communication link between the target train and the at least one identifying train; determining or receiving, by the target train, position data by the at least one identifying train; comparing, by the target train, at least a portion of the position data with at least a portion of the authority data; based at least partially on the comparison, generating at least one indication that the target train is authorized to proceed; and based at least partially on the at least one indication, displaying, on a visual display device 24 in at least one locomotive 10 of the target train, an authorization indication.

In a still further preferred and non-limiting embodiment, provided is a system for managing conditional authorities in a vehicle network for a target train, including: receiving a conditional authority by the target train, wherein the conditional authority includes authority data related to at least one identifying train; directly or indirectly transmitting, by the target train to the at least one identifying train, at least a portion of the authority data; comparing, by the at least one identifying train, position data with at least a portion of the authority data; directly or indirectly transmitting, by the at least one identifying train to the target train, the results of the comparison; based at least partially on the results of the comparison, generating at least one indication that the target train is authorized to proceed; and based at least partially on the at least one indication, displaying, on a visual display device 24 in at least one locomotive 10 of the target train, an authorization indication.

In one exemplary embodiment, and in accordance with the principles of the present invention, the on-board computer 12 (or on-board segment of the system) accepts a conditional authority from the back office server 23 (or central dispatch). When this occurs, the on-board computer 12 sends a request for position or location information to the on-board computer 12 of each identifying locomotive 10 identified in the movement authority dataset (i.e., authority data). The on-board computer 12 (or on-board segment) on each identifying locomotive starts to periodically report its location to the locomotive (of the target train) holding the conditional authority. In another exemplary embodiment, the identifying trains periodically report position data to the back office server 23, and the back office server 23 forwards that data to a target train based upon information in the conditional authority. Since the back office server 23 has the authority data associated with the conditional authority, including the target train and identifying trains, it can be configured to forward position data from the identifying trains to the target train.

In another exemplary embodiment, and when the on-board computer 12 accepts or receives a conditional authority from the back office server 23, the on-board computer 12 will send a request for location information to the on-board computer 12 on each identifying locomotive identified in the movement authority data set. The on-board computer 12 on each identifying locomotive will then start to periodically report its location to the locomotive holding the conditional authority. In this embodiment, there are two primary options for the creation and/or content of the location information.

Figure 8:
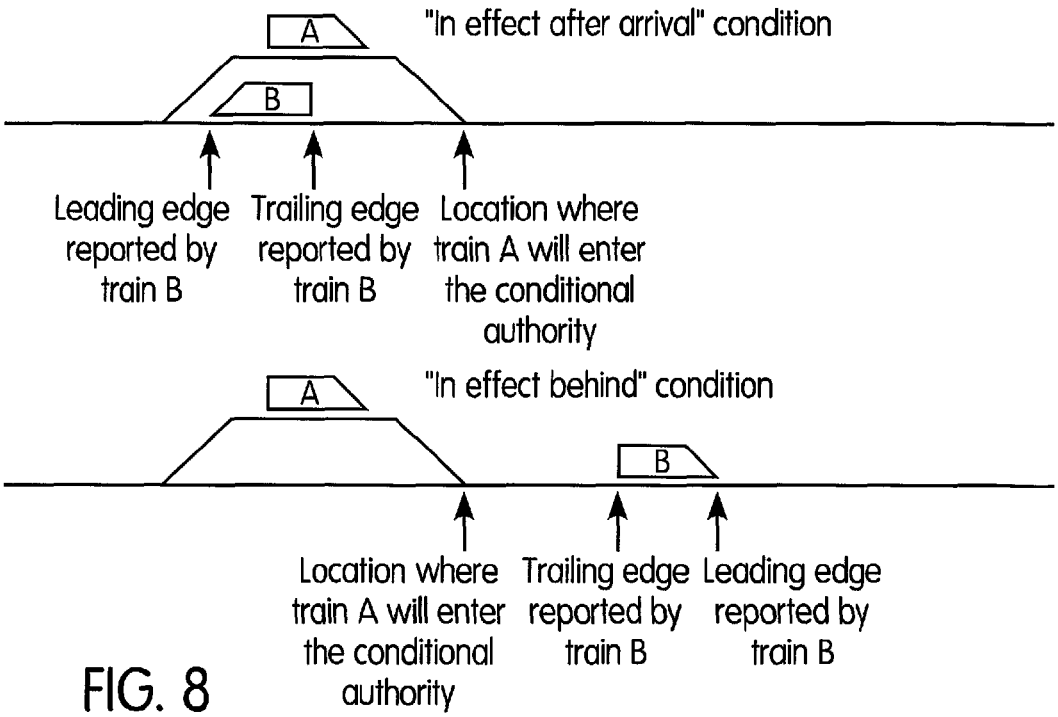
FIG. 8 is a schematic view of one embodiment of a computer-implemented method and system for managing conditional authorities in a vehicle network implemented for a specified arrangement of trains in a track network according to the present invention.

The first primary option is to have the on-board computer 12 of each identifying locomotive report its track location of the leading and trailing edges of its train. This may take the form of a milepost within the applicable prefix or suffix, track name, subdivision identifier, and/or Standard Carrier Alpha Code (SCAC) of the railroad that operates the subdivision. Alternatively, the location could be formatted as a block identifier, offset into the block, subdivision identifier, and/or railroad SCAC. The on-board computer 12 on the locomotive holding the conditional authority will search for or identify the reported track location using the track database 14 (or the database where the information is stored), and determine where that location is relative to the position or location at which the train will enter the conditional authority. If the location reported by an identifying locomotive indicates that the entire train is clear of a specified or determine position or location, e.g., entry point, "at" location, and/or the like, the locomotive holding the conditional authority will consider that train to have "arrived". The on-board computer 12 on the train holding the conditional authority will then use the condition type (e.g., "in effect after arrival" or "in effect behind") to determine on which side of the position or location the named train needs to be in order to consider that train to have "arrived". FIG. 8 illustrates this option as implemented in both the "in effect after arrival" condition and the "in effect behind" condition. The location report from the identifying locomotive may also include the level of position uncertainty calculated by the on-board computer 12 on that locomotive in the course of its navigation, such that the on-board computer 12 on the locomotive holding the conditional authority can determine whether the named train has cleared the position or location by at least that distance. One advantage to this first option is that the information reported by the identifying locomotive is already calculated by the on-board computer 12 as a matter of normal operation. However, it is recognized that the on-board computer 12 on the locomotive holding the conditional authority may be programmed or configured to "walk the track" between the location of the named train and the entry point.

Figure 9:
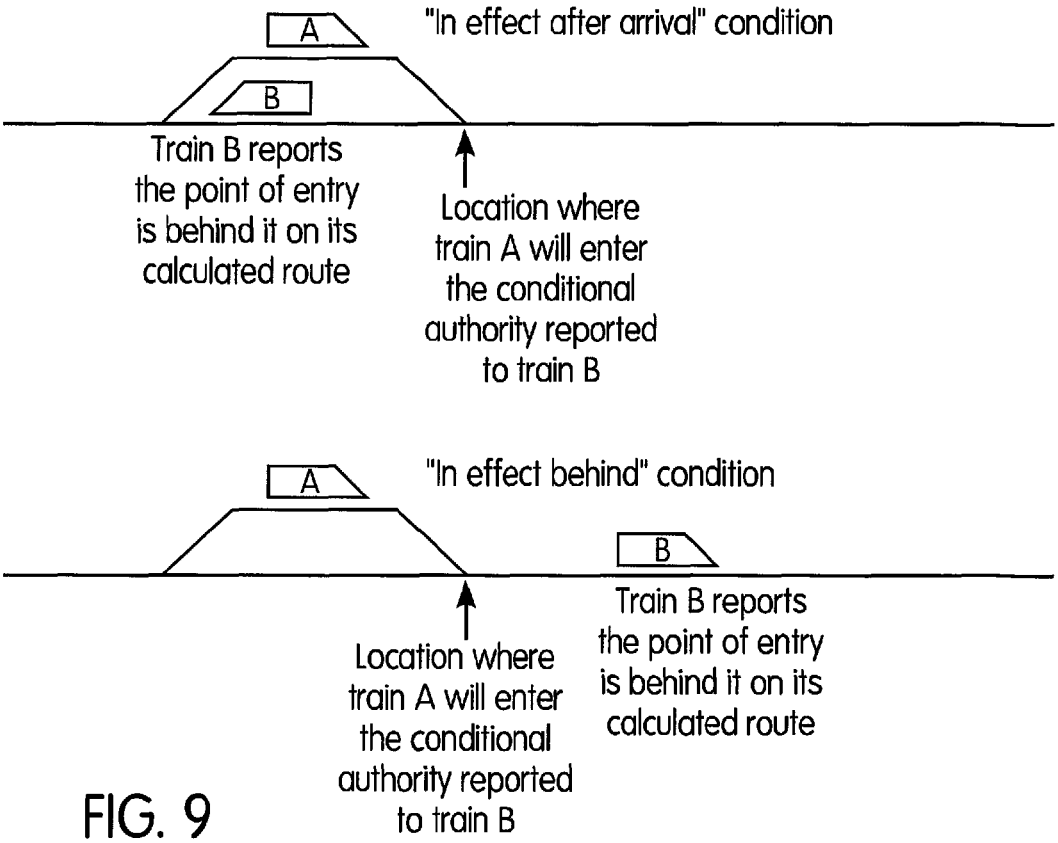
FIG. 9 is a schematic view of another embodiment of a computer-implemented method and system for managing conditional authorities in a vehicle network implemented for another specified arrangement of trains in a track network according to the present invention.

With reference to FIG. 9, and in this exemplary embodiment, the second option includes having the on-board computer 12 of the identifying locomotive report its location relative to the some determined position or location. In this option, the on-board computer 12 on the train holding the conditional authority determines where the train will enter that authority, and reports that track location to each identifying locomotive when it sends the request for location information. The on-board computer 12 on each identifying locomotive then identifies that position or location on its calculated route. When the identifying locomotive makes a periodic location report, it also reports its location relative to the position or location as either ahead of the train on its calculated route, behind the train on its calculated route, or not on its calculated route. When an identifying locomotive reports that the position or location is behind the train on its calculated route, the train holding the conditional authority considers that train to have "arrived". The on-board computer 12 on the identifying locomotive may also calculate or take into account its calculated position uncertainty in order to provide a greater degree of accuracy that the train has cleared the location in question by at least a specified distance. FIG. 9 illustrates this option as implemented in both the "in effect after arrival" condition and the "in effect behind" condition.

If the on-board computer 12 on an identifying locomotive reports that the determined or specified position or location is not on its route, no determination is required. Further, if the position or location never appears on the identifying locomotive calculated route behind the train, in this embodiment, intervention by the dispatcher, e.g., the back office server 23, may be required to void the conditional authority, and issue a non-conditional authority once the dispatcher has verified that the track is clear. While it is recognized that this option requires additional computing by the on-board computer 12 on the identifying locomotive, since the search for the point of interest is limited to the identifying locomotive's calculated route, the computing resources are minimal and less variable. In addition, and in this option, the logic for both the "in effect after arrival" condition and the "in effect behind" condition is identical, i.e., a location on the route behind the named train clears the train for that condition.

In another exemplary embodiment, the communication between the locomotive holding the conditional authority and the identifying locomotives may occur in a variety of options and configurations. First, the communication path may be in the form of locomotive-to-locomotive communication. In particular, the first option in this exemplary embodiment for sending messages is directly between the locomotive holding the conditional authority and the identifying locomotives of the named trains. The locomotive holding the conditional authority may initiate an exchange of security information with each of the identifying locomotives. This allows subsequent messages to be authenticated. The locomotive holding the conditional authority then requests that the identifying locomotives periodically report their location. The identifying locomotive will then stop reporting its location either when its train has cleared the point of interest, e.g., a specified or determined position or location, or when it receives a message from the locomotive holding the conditional authority indicating that location reports are no longer required. One advantage of this direct communication is that the on-board computer 12 in the PTC system is a "vital" system, and the messages are not passed through any "non-vital" intermediary, e.g., the back office server 23.

If the locomotive-to-locomotive communication option is implemented, a new Interface Control Document (ICD) may be developed to specify messages to be exchanged between locomotives to request and provide location information, and to exchange the security information needed to authenticate those messages. For example, the Movement Authority Dataset (01051) message in the PTC Office-Locomotive Segment ICD may be updated to include Edge Message Protocol (EMP) address information for each identifying locomotive, such that the on-board computer 12 on the locomotive holding the conditional authority will understand how to contact the identifying locomotives. It is noted that the locomotive identifier, by itself, may be insufficient, as both the recording marks and the owning railroad SCAC are required, and they may not match, e.g., in the case of a leased locomotive.

Another option in this exemplary embodiment is to provide communication via the back office server 23. In particular, the locomotive holding the conditional authority will pass the required messages or requests through the back office server 23 to the identifying locomotives of the named trains. This communication path may occur over established validated and authenticated communication paths between the locomotives and the back office server 23. Accordingly, additional exchange of security information may not be required. In this option, the request for location reports, and the location reports themselves, would be relayed between the appropriate locomotives via the back office server 23. One advantage to this communication path is the increased visibility of the process through the back office server 23 for the dispatcher, as well as other system users, for real-time monitoring and/or incident investigation. However, as noted above, the back office server 23, is a "non-vital" component of the PTC system. If the communication path uses the back office server 23 as the intermediary, the ICD may specify new messages that can be added to the existing PTC Office-Locomotive Segment ICD to request and provide location information. However, it should be recognized that even though the back office server 23 is a "non-vital" component, the messages from one locomotive 10 to another could be constructed to maintain their "vital" integrity even if routed through the back office server 23. Accordingly, in another preferred and non-limiting embodiment, a message integrity check (e.g., the CRC) may be included to facilitate and/or permit the routing of vital messages between locomotives 10 through non-vital systems and components.

Figure 10:
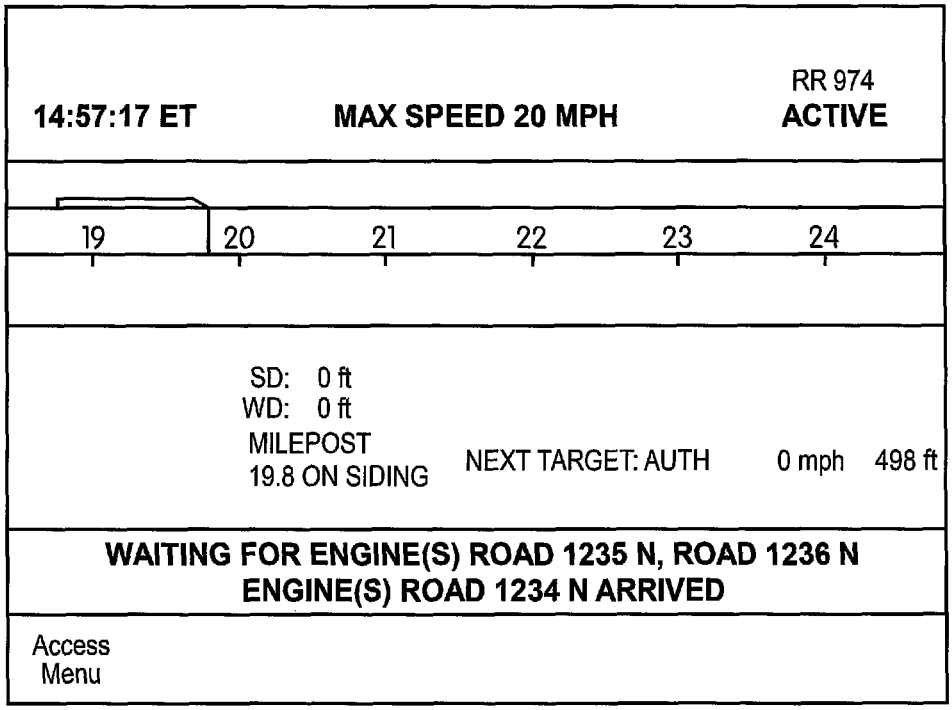
FIG. 10 is an exemplary operator display generated in accordance with a computer-implemented method and system for managing conditional authorities in a vehicle network implemented for another specified arrangement of trains in a track network according to the present invention.

In this exemplary embodiment, and with respect to crew feedback, certain information, data, and/or prompts, will be provided to the train operator on the visual display device 24 in the locomotive. In particular, and as illustrated in FIG. 10, in one preferred and non-limiting embodiment, a prompt will be displayed to the operator when the train is waiting outside the limits of a conditional authority to provide the status to the crew as to which named trains have arrived and which named trains are still due.

With continued reference to this exemplary embodiment, and if the identifying locomotives on any of the trains named in the conditional authority are not equipped with the appropriate on-board computer 12 and/or on-board segment, the on-board computer 12 on the locomotive that receives the conditional authority may not be able to verify the location of that named train, and may then not be able to clear the zero miles per hour target over the conditional authority limits. In this instance, intervention by the dispatcher may be required to void the conditional authority and issue a non-conditional authority once the dispatcher has verified that the track is clear.

In another preferred and non-limiting embodiment, the target train, e.g., the on-board computer 12 of the target train, determines an entry point or "at" location based upon data and information in the authority data of the conditional authority. In particular, the target train has a calculated route, and can make a determination where the limits of the conditional authority overlap that route. Accordingly, the position or location on the route beyond which the target train may not proceed due to the authority data in the conditional authority would be considered the entry point or "at" location.

In this manner, provided are an improved computer-implemented method and system for managing conditional authorities in a vehicle network, such as a complex rail network. In particular, the above-described computer-implemented methods and systems facilitate the ability to manage data from multiple locomotives and/or trains travelling in a track or rail network, and further facilitate effective communication and data exchange between trains in order to accurately manage authorizations and implementations of conditional authorities.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A computer-implemented method for managing conditional authorities in a vehicle network for a target train, comprising:

generating at least one conditional authority for the target train, the at least one conditional authority comprising authority data related to at least one identifying train, wherein the authority data comprises at least one of the following: entry point data, "at" location data, train data, identifying train data, condition data, or any combination thereof;

based upon the authority data, determining each identifying train in the at least one conditional authority;

establishing at least one direct or indirect communication link between at least one communication device of the target train and at least one communication device of each identifying train;

directly or indirectly transmitting at least a portion of the position data from the at least one communication device of each identifying train to the communication device of the target train;

comparing, by at least one on-board computer, at least a portion of the position data with at least a portion of the authority data; and based at least partially on the comparison, generating, by the at least one on-board computer, at least one indication that the target train is authorized to proceed.

2. The method of claim 1, further comprising transmitting, to at least one back office server, at least a portion of at least one of the following: authority data, train data, entry point data, "at" location data, identifying train data, condition data, target train data, position data, indication data, track data, switch data, heading data, distance data, locomotive data, train data, navigation data, tachometer data, or any combination thereof.

3. The method of claim 1, wherein the at least one conditional authority further comprises authority type, including at least one of the following: direction data, position data, condition data, "in effect after arrival" data, "in effect behind" data, or any combination thereof.

4. The method of claim 1, wherein the direct or indirect transmission step is responsive to transmitting, from the target train to at least one identifying train, a request for the position data.

5. The method of claim 1, further comprising directly or indirectly receiving, at the target train, at least a portion of the position data as transmitted from at least one of the following: at least one identifying train, at least one back office server, at least one other train, at least one wayside device, or any combination thereof.

6. The method of claim 1, wherein the position data comprises at least one of the following: train leading edge data, train trailing edge data, milepost data, prefix data, suffix data, track name, subdivision identifier, track data, railroad data, block identifier, offset data, or any combination thereof.

7. The method of claim 1, further comprising:

based at least partially on the position data received from each identifying train, determining, by the target train, whether the at least one identifying train meets at least one condition in the authority data;

if the position or location of the at least one identifying train indicates that it meets the at least one condition, generating a "clear" indication; and if the position or location of the at least one identifying train indicates that it does not meet the condition:

(i) maintaining a "not clear" indication; and (ii) requesting, receiving, or determining subsequent position data from the at least one identifying train.

8. The method of claim 7, wherein the at least one condition comprises at least one of the following: at least one entry point, at least one "at" location, at least one condition of the at least one identifying train, at least one condition of the target train, at least one position or location of the at least one identifying train, at least one position or location of the target train, or any combination thereof.

9. The method of claim 7, wherein the at least one condition is determined after receipt of the at least one conditional authority.

10. The method of claim 1, further comprising:

based at least partially on the position data received from the at least one identifying train, determining, by the target train, the position or location of at least one identifying train;

if the position or location of the at least one identifying train indicates that it meets at least one condition in the authority data, generating a "clear" indication; and if the position or location of the at least one identifying train indicates that it does not meet that at least one condition in the authority data:

(i) maintaining a "not clear" indication; and (ii) requesting, receiving, or determining subsequent position data from the at least one identifying train.

11. The method of claim 10, wherein the "clear" indication is based at least partially on the identification of an "in effect after arrival" indication or an "in effect behind" indication in the at least one conditional authority.

12. The method of claim 1, wherein the position data comprises position uncertainty data.

13. The method of claim 12, further comprising determining position uncertainty data.

14. The method of claim 1, wherein the position data is determined by the at least one identifying train, the position data comprising the position or location of the at least one identifying train with respect to at least one condition in the authority data, the method further comprising:

if the position or location of at least one identifying train indicates that it meets the at least one condition in the authority data, generating a "clear" indication; and if the position or location of the at least one identifying train indicates that it does not meet the at least one condition in the authority data:

(i) maintaining a "not clear" indication; and (ii) requesting, receiving, or determining subsequent position data from the at least one identifying train.

15. The method of claim 14, wherein the "clear" indication is based at least partially on the identification of an "in effect after arrival" indication or an "in effect behind" indication in the at least one conditional authority.

16. The method of claim 1, further comprising determining, by the at least one identifying train, at least one position or location on its calculated route, wherein the position data directly or indirectly transmitted to the target train comprises the position of the at least one identifying train with respect to the location on its calculated route.

17. The method of claim 16, wherein the position data comprises at least one of the following: the at least one determined position or location is behind the at least one identifying train on its calculated route, the at least one determined position or location is ahead of the at least one identifying train on its calculated route, or the at least one determined position or location is not on its calculated route.

18. The method of claim 17, wherein the position data comprises position uncertainty data.

19. The method of claim 16, wherein, if the at least one determined position or location does not appear on the route travelled by the at least one identifying train, the method further comprises at least one of the following: voiding the at least one conditional authority, issuing at least one non-conditional authority, or any combination thereof.

20. The method of claim 1, wherein the at least one direct or indirect communication link between the target train and the at least one identifying train is at least one secured communication link directly between the target train and the at least one identifying train.

21. The method of claim 20, further comprising terminating the at least one secured communication link based at least partially on at least one of the following: a termination command received by the at least one identifying train, a determination that the at least one identifying train has passed a specified position or location, or any combination thereof.

22. The method of claim 1, wherein the at least one direct or indirect communication link between the target train and the at least one identifying train is at least one indirect communication link established between the target train and at least one of the following: at least one identifying train, at least one back office server, at least one other train, at least one wayside device, or any combination thereof.

23. The method of claim 1, further comprising:

generating a status of the at least one identifying train; and displaying the status on at least one visual display device in at least one locomotive of the target train.

24. The method of claim 1, further comprising:

determining that at least one of the target train and the at least one identifying train is not equipped with a specified train control system;

voiding the at least one conditional authority; and issuing at least one non-conditional authority.

25. The method of claim 1, further comprising determining, by the target train, at least one entry point based at least partially on the authority data in the at least one conditional authority.

26. A system for managing conditional authorities in a vehicle network for a target train, comprising:

receiving at least one conditional authority by the target train, the at least one conditional authority comprising authority data related to at least one identifying train, wherein the authority data comprises at least one of the following: entry point data, "at" location data, train data, identifying train data, condition data, or any combination thereof;

based upon the authority data, determining each identifying train in the at least one conditional authority;

establishing at least one direct or indirect communication link between at least one communication device of the target train and at least one communication device of each identifying train;

receiving, by at least one communication device of the target train, position data of each identifying train;

comparing, by at least one on-board computer of the target train, at least a portion of the position data with at least a portion of the authority data;

based at least partially on the comparison, generating, by the at least one on-board computer of the target train, at least one indication that the target train is authorized to proceed;

based at least partially on the at least one indication, displaying, on a visual display device in at least one locomotive of the target train, an authorization indication.

27. A system for managing conditional authorities in a vehicle network for a target train, comprising:

receiving at least one conditional authority by the target train, the at least one conditional authority comprising authority data related to at least one identifying train, wherein the authority data comprises at least one of the following: entry point data, "at" location data, train data, identifying train data, condition data, or any combination thereof;

directly or indirectly transmitting, by at least one communication device of the target train to at least one communication device of the at least one identifying train, at least a portion of the authority data;

comparing, by at least one on-board computer of the at least one identifying train, position data with at least a portion of the authority data;

directly or indirectly transmitting, by the at least one communication device of the at least one identifying train to the at least one communication device of the target train, the results of the comparison;

based at least partially on the results of the comparison, generating, by at least one on-board computer of the target train, at least one indication that the target train is authorized to proceed; and based at least partially on the at least one indication, displaying, on a visual display device in at least one locomotive of the target train, an authorization indication.

* * * * *